US011089896B2

(12) United States Patent
Damiani

(10) Patent No.: US 11,089,896 B2
(45) Date of Patent: Aug. 17, 2021

(54) SPILL SAVER TRAY

(71) Applicant: Damian Damiani, Fullarton (AU)

(72) Inventor: Damian Damiani, Fullarton (AU)

(73) Assignee: Damian Damiani, Fullarton (AU)

( * ) Notice: Subject to any disclaimer, the term of this patent is extended or adjusted under 35 U.S.C. 154(b) by 253 days.

(21) Appl. No.: 16/329,933

(22) PCT Filed: Aug. 31, 2017

(86) PCT No.: PCT/AU2017/050931
§ 371 (c)(1),
(2) Date: Mar. 1, 2019

(87) PCT Pub. No.: WO2018/039725
PCT Pub. Date: Mar. 8, 2018

(65) Prior Publication Data

US 2019/0223642 A1 Jul. 25, 2019

(30) Foreign Application Priority Data

Sep. 2, 2016 (AU) ..... 2016903526

(51) Int. Cl.
*A47G 23/06* (2006.01)
*B65D 1/34* (2006.01)

(52) U.S. Cl.
CPC ..... *A47G 23/0625* (2013.01); *B65D 1/34* (2013.01)

(58) Field of Classification Search
CPC .... A47G 23/0625; A47G 23/06; A47G 19/08; A47J 45/10; F16B 47/00
USPC ..... 294/144, 172, 159; 206/557, 563; 220/771, 772, 760, 776, 914
See application file for complete search history.

(56) References Cited

U.S. PATENT DOCUMENTS 1,071,705 A 9/1913 Collins
3,162,344 A * 12/1964 Sabol ..... A47G 23/0625 294/143
3,315,858 A 4/1967 Horner
3,955,672 A * 5/1976 Brundage ..... A47G 19/065 206/562
5,076,438 A * 12/1991 Aronson ..... A47G 23/0625 206/557
5,960,982 A * 10/1999 Perlis ..... A47G 19/065 206/558
7,000,799 B1 * 2/2006 Hamre ..... A47G 19/065 220/23.8
7,717,483 B1 * 5/2010 Bombara ..... A47G 23/0625 294/172

(Continued)

FOREIGN PATENT DOCUMENTS

GB 248226 3/1926

OTHER PUBLICATIONS

Australian Search Report and Written Opinion issued in Application No. 2016903526, dated Jan. 25, 2017, 8 pgs.

(Continued)

*Primary Examiner* — Paul T Chin
(74) *Attorney, Agent, or Firm* — Woodard, Emhardt, Henry, Reeves & Wagner, LLP

(57) ABSTRACT

A tray for carrying items, such as food and beverages. In particular, the tray, provided with grips, can be carried, in a relatively stable manner, with one hand. The tray is particularly useful for individuals working in the hospitality industry, such as waiting staff (waiters).

17 Claims, 3 Drawing Sheets

(56) References Cited

U.S. PATENT DOCUMENTS

| | | | | |
|---|---|---|---|---|
| 7,975,623 | B1 | 7/2011 | Gassick et al. | |
| 8,794,686 | B2 * | 8/2014 | Grieve | A47G 23/0625 294/172 |
| 9,549,629 | B2 * | 1/2017 | Bourget | A47G 23/0633 |
| 2006/0032780 | A1 * | 2/2006 | Heyn | A47G 23/0625 206/557 |
| 2007/0215512 | A1 * | 9/2007 | Bellissimo | A47G 23/0625 206/557 |
| 2014/0374425 | A1 * | 12/2014 | Duckett | A47G 23/0625 220/606 |
| 2015/0359368 | A1 * | 12/2015 | Bachar | A47G 23/0625 206/459.5 |
| 2017/0172329 | A1 * | 6/2017 | Wickstrom | A47G 23/0625 |

OTHER PUBLICATIONS

International Search Report issued in PCT/AU2017/050931, dated Mar. 8, 2018, 3 pgs.

* cited by examiner

SPILL SAVER TRAY

This application claims priority from Australian provisional patent application number 2016903526 filed on 2 Sep. 2016, the contents of which are to be taken as incorporated herein by this reference.

TECHNICAL FIELD

The present invention relates to serving trays for carrying food and beverages and the like, for use in the hospitality industry. More particularly, the present invention relates to an ergonomic serving tray having grips.

BACKGROUND OF INVENTION

In the hospitality industry, it is often necessary to serve more items (such as drinks) than can be comfortably carried by hand. To address this, a waiter can either make several trips, which is inefficient, or can transport the items on a serving tray.

Typical serving trays used in the hospitality industry take two general forms: The first is a serving tray, which is either rectangular or rounded, and has two opposing handles that extend outwardly and above the tray. These trays are generally griped by the waiter from above, and require the use of two hands. The second type of tray is substantially planar with an upper surface, for placing the item(s) for carriage, and an underside, which is supported by the waiter, typically using his or her arm, which is bent such that the forearm is parallel to the ground and the tray sits on a spread and supine hand, with the palm upward facing. However, both of these trays are problematic when used.

The requirement to use two hands to carry a tray means that in order to serve the item(s) on the tray, the tray needs to be set down. In a crowded venue, a cocktail event, or in a full restaurant there may not be a suitable surface to set the tray down. As a result, in some silver service venues a second person will accompany the tray and will serve the items. However, this incurs additional expense and is not practical in many circumstances.

The use of a serving tray carried by a single hand addresses some of these problems. By freeing up one of the waiter's hands, items (such as drinks) can be transported and then served, while the tray is being held. Moreover, a waiter can pick up used items, place them on the tray, and carry them back to the kitchen or bar without the need to put the tray down.

However, supporting the tray with only one hand significantly compromises the stability of the tray, which is further compromised by the tray simply sitting on a waiter's hand. This lack of stability can be particularly problematic when people, other than the waiter, are free to remove items from the tray ad libitum. Commonly, in such situations, multiple items are removed from, or placed on, one side of the tray at once, resulting in the tray becoming unbalance and can easily tip over, spilling the remaining items. To compensate for this, the waiter carrying the tray will often spread their fingers so the widest possible base is provided. Problematically, however, this action can lead to pain and fatigue in the hand. In cases where a waiter carries a tray for a prolonged period, such as stand-up or cocktail functions, this may lead to significant discomfort, and in worst case scenarios may lead to a strain or stress injuries such as tendonitis or tenosynovitis.

The Handle Tray™ provides one attempted solution to the above problems. This tray is provided with a strap that sits across the back of the hand when the tray is being carried, and helps stabilise the tray. However, this tray still requires the hand to be splayed to carry the tray, and therefore does little to prevent fatigue or injury when carrying the tray. Furthermore, the placement of the strap does little to stabilise the tray from tipping in the forward and backward direction.

In light of the above, there is a need to provide a waiter's tray that can be easily carried with one hand, and is more stable and ergonomic than serving trays presently available.

The discussion of documents, acts, materials, devices, articles and the like is included in the background of this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF INVENTION

In one aspect, the invention provides a serving tray, including: an upper side adapted for supporting and carrying items to be served; and an underside including a non-centrally located grip, the grip adapted to permit the manual support of the serving tray by a hand having a generally supine palm.

The non-centrally located grip(s) improve stability of the serving tray in multiple directions when carried with only one hand. The presence of the grip helps stabilise the tray to prevent it from tipping sideways. Furthermore, the non-central location of the grip permits the tray to be held in such a way that the waiter's hand can support the front side of the tray (i.e. the side distal to the waiter) while the back side of the tray (i.e. the side proximal to the waiter) can be supported by the waiter's arm, preferably forearm. This stabilises the tray to prevent it tipping forward or backward. The improved stability helps prevent the tray from toppling when carried, or when items are removed from, or place on, the tray. Importantly, by locating the grip on the underside of the tray, the fingers of the waiter do not encroach upon the upper side of the tray. Therefore, in a preferred embodiment, the grip is positioned so that the hand (including the fingers) of the waiter is not visible when the tray is being carried and viewed from above.

Consequently, in some embodiments, the underside of the serving tray includes a portion adapted to be supported by a forearm. In a further embodiment, the portion adapted to be supported by a forearm is positioned, on the underside of the tray, such that it is centrally-opposed to the non-centrally located grip. As used herein, the term "centrally opposing" means located on the opposite side of the centre of the tray.

The tray can comprise any desired shape. In some embodiments, the shape of the tray has at least three equally spaced diametrical lines of symmetry. In some embodiments, the shape of the tray is a circle.

The tray can consist of any desired material known in the art. These may include, but are not limited to, metals (such as aluminium and stainless steel), plastics (such as uPVC, polyethylene), fibreglass or any other material known to be suitable. In some embodiments, the tray includes hydrophobic materials, or is coated or lined with such materials.

The portion adapted to be supported by the forearm can be any suitable surface that will be able to abut the upward-facing surface of a forearm, when the waiter's palm is in a supine position. In some embodiments, the portion of the underside of the tray adapted to be supported by the forearm is provided by a planar surface. However, alternative support structures are envisaged. In some embodiments, the portion of the underside of the tray adapted to be supported by the forearm is provided by a contoured recess. In some embodiments, the portion of the underside of the tray adapted to be supported by the forearm is provided by a lower surface of a centrally-opposing grip, which may be planar or contoured.

The grip can be any suitable grip which allows the tray to be supported by a generally supine palm. However, in a preferred embodiment of the invention, the grip includes a portion adapted for engagement by the fingers of the hand. Preferably, the grip is adapted to be gripped with one or more fingers of the hand curled inward toward the supine palm. This position, with the palm of the hand supine and the fingers curled inward toward the palm, provides both a firm grip of the serving tray and may provide a more ergonomic and comfortable grip on the tray compared to a spread hand. This improved ergonomics may allow the tray to be carried for prolonged periods with reduced fatigue in the waiter's hand and decreased chance of injury to the hand.

The grip can be provided by any suitable means on the underside of the tray. However, in a preferred embodiment, the grip includes a protrusion on the underside of the serving tray. In a further preferred embodiment, the grip is provided by a protrusion on the underside of the serving tray. By including a protrusion, or being provided by a protrusion, the grip of the present invention can be configured to better fit within the supine hand of a waiter. In some embodiments, the protrusion includes a surface adapted to be supported by the generally supine palm. This can allow for a more extended wrist position, rather than the palm of the hand being spread and in a neutral position (i.e. in-line with the forearm). Consequently, the protrusion can further allow for a more ergonomic means of supporting the tray, which can further reduced fatigue and stress of the hand, wrist and forearm.

In some embodiments, the grip of the serving tray includes a recessed portion adapted for engagement by the fingers of the hand. The recess can be engaged by the curled fingers of the waiter's hand (as described above) and the palm of the hand can sit on a portion of the tray, or the grip, which is adapted to be supported by the palm. In some embodiments, the recess is provided in the underside of the tray.

Trays such as the serving tray of the present invention, are generally required to be regularly washed. As such, in some embodiments, the recessed portion of the serving tray includes a drainage hole to permit drainage of water from the recessed portion during washing. Alternatively, in some embodiments the grip of the serving tray includes an aperture adapted for engagement by the fingers of the hand. The aperture is engaged by the fingers of the waiter in the same manner as the recess described above. However, as would be understood to a person skilled in the art, the aperture would not require a drainage hole.

The gripping of the tray with a hand having a palm in a generally supine position is beneficial compared to a medially facing (neutral) hand, or a pronated hand, for several reasons. Firstly, having a supine palm consequently rotates the forearm to a supine position. This provides a wider and more stable base for the portion adapted to abut the forearm, to sit on. Secondly, a grip adapted to be held by a hand having a supine palm is generally more compact than a grip to be held by a hand having a medially facing palm. As such, in embodiments of the invention whereby the gip includes, or is provided by, a protrusion, the distance that the protrusion extends from the underside of the tray is reduced compared to a grip adapted to be carried by a hand with a medially facing palm. Further, a supinated arm is typically stronger in flexion, than when the hand is in a neutral or pronated position. This allows greater weight to be carried for longer.

As described above, in some embodiments the grip of the serving tray can include a recessed portion, or an aperture, adapted for engagement by the fingers of a hand. Therefore, in some embodiments, when the grip includes, or is provided by, a protrusion, the protrusion can include a recess, or aperture, for engagement with the fingers of a hand.

In some embodiments of the invention, whereby the grip includes a protrusion, the protrusion is adapted to be gripped with the palm of a hand in a generally supine position and one or more fingers of the hand curled inward toward the palm. In embodiments, whereby a recess or aperture is provided, the inwardly curled fingers can locate within, and engage, the recess or aperture. This allows for the waiter to securely grip the tray in a comfortable and natural manner.

In some embodiments of the invention, which include a protrusion, the recess or aperture for engagement with the fingers of a hand is located toward the periphery of the tray and a centrally-facing side of the protrusion is generally contoured such that it is shaped to conform to the heel of the palm.

In some embodiments, the contour is provided by a portion of the protrusion which tapers in a direction toward the centre and the bottom surface of the tray. That is to say, that a portion of the protrusion tapers inwardly toward the tray. Such a contoured portion, further adds to the ergonomics of the grip of the invention.

In some embodiments, the portion of the protrusion adapted to be supported by the generally supine palm has an edge, facing the centre of the tray, which is laterally extending and generally convex (relative to the protrusion). Resultantly, in some embodiments, the centrally-facing edge of the protrusion can include a taper toward the centre of the tray and a convex curve. Both of these features, in isolation, and when combined, can further improve the ergonomics of the grip of the present invention.

In some embodiments, the portion of the protrusion adapted to be supported by the generally supine palm has an edge, facing the periphery of the tray, which is laterally extending and generally concave (relative to the protrusion). In some embodiments, this peripheral edge of the protrusion is adjacent the recess or aperture described above. Resultantly, when the grip is being held, and the fingers of a waiter's hand are curled back toward the palm of the hand, the concave edge is better adapted to fit the natural curve of the fingers in the contracted position, therefore providing a more ergonomic hold on the grip.

In a preferred embodiment, the underside of the tray includes more than one grip. By having multiple grips the tray can be held in more than one orientation, thereby allowing a user to more easily orient and carry the tray when items are already placed on the upper side of the tray. In some embodiments, the underside of the tray includes an odd number of grips. In some embodiments, the grips are not centrally-opposed to other grips included on the underside of the tray. In some embodiments, no portion of the grips are centrally opposed to any portion of another grip. This orientation of grips on the underside of the tray means that the surface of the underside of the tray, centrally-opposing the grips, can provide a portion adapted to be supported by a forearm when the tray is being carried. Resultantly, the number of portions adapted to be supported by the forearm is equal to the number of grips on the underside of the tray. In embodiments having, three grips on the underside of the tray, the underside of the tray also includes three portions adapted to be supported by a forearm. In this orientation, portions adapted to be supported by a forearm interspace the grips. In some embodiments, these portions are provided by the surface defining the underside of the tray. In some embodiments, the tray has three grips, with no centrally located grip, which would impede carrying of the tray by a waiter.

In some embodiments, the grips are positioned on the underside of the tray, such that the radial angle traversing the midpoint of each grip is identical. In some embodiments, the grips are evenly spaced on the underside of the tray relative to the centre of the tray, and/or relative to each other.

In one aspect, the present invention provides a serving tray, including: an upper side adapted for supporting and carrying items to be served; and an underside including three non-centrally located grips, the grips adapted to permit the manual support of the serving tray by a hand having a generally supine palm, wherein the underside includes three portions adapted to be supported by a forearm of the waiter.

Typically, items are served from the serving tray while being carried, in some instances it is desirable to place the tray on a surface such as a table. Furthermore, when not in use, serving trays can be stored by stacking them on top of each other. Therefore, it is desirable and advantageous for the tray of the present invention to be able to sit parallel to a surface upon which it is placed. As such, in some embodiments of the present invention, the underside of the tray is configured such that when the tray is placed on a surface, the upper side of the tray will sit parallel to surface upon which the tray is placed. This can be achieved by a variety of means.

In some embodiments, the underside of the tray can provide a substantially planar surface, which will abut the surface upon which the tray is placed (including the upper side of other trays). Such a planar surface may be achieved when the grip is provided as a recess in the underside of the tray.

In some embodiments, the underside of the tray may include a series of protrusions which define a notional plane. Such embodiments are particularly relevant when the grip includes, or is provided by, a protrusion. A single, non-centrally located protrusion from the underside of the serving tray may result in the upper side of the tray failing to sit parallel to a surface upon which the tray is placed. Therefore, in further preferred embodiments, the underside of the tray may include more than one protrusion, in addition to the grip(s). The orientation, number, and type of protrusion (in addition to the grip(s)) may be dependent on the type and number of grips included on the bottom of the tray. For example, in embodiments where the tray is provided with a single grip, including a protrusion, the tray may include a further protrusion that extends from the underside of the tray and abuts a support surface, such as a table, when the tray is set down. In some embodiments the tray includes two, there, four or more protrusions in addition to the grip.

In a preferred embodiment, the serving tray of the present invention includes three grips, each grip including, or being provided by, a protrusion. In such an embodiment, the grips can be equally spaced about the centre of the tray, such that they provide a triangle arrangement, with each grip being centrally-opposed by, and interspaced with, a portion of the tray adapted to be supported by the forearm of the waiter. In some embodiments, the grips are positioned equidistant from each other. This arrangement is particularly advantageous as the protrusions provide a tripod arrangement that allows the tray to sit level, and stably, on a support surface, with the upper side of the tray parallel to the support surface. Further, this uniformity means the tray of the present invention can be carried in multiple orientations. Depending on the size and width of the grips, similar results can be obtained with five or seven grips. In a preferred embodiment, the tray comprises only three grips.

In some embodiments, each of the three non-centrally located grips include at least one downwardly projecting protrusion that extends beyond a lower surface of each grip, and abuts a support surface when the tray is positioned thereon. In some embodiments, the at least one downwardly projecting protrusions that extends beyond a lower surface of each grip is laterally positioned on each grip so as not to interfere with a palm contacting the lower surface of the grip. In some embodiments, each of the three non-centrally located grips include at least two downwardly projecting protrusions that extend beyond a lower surface of each grip and abut a support surface when the tray is positioned thereon.

In some embodiments, the grips(s) include downwardly-projecting lateral protrusions, which, when the tray is gripped, extend down each the side of the hand. These downwardly-projecting lateral protrusions, help locate and stabilise the hand on the grip and elevate the grips off a support surface when the tray is not in use. This elevation from the support surface is particularly advantages in promoting drying after the tray has been washed.

Throughout this specification, the serving tray has been described in use by a waiter, or the like. The term waiter, as used, refers to a server of food and/or beverages (amongst other items) and is not to be interpreted as limiting the use of the invention to a specific gender, or to limit the use to a professional context.

Throughout this specification, unless the context requires otherwise, the word "comprise", or variations such as "comprises" or "comprising", will be understood to imply the inclusion of a stated element or integer or group of elements or integers but not the exclusion of any other element or integer or group of elements or integers.

BRIEF DESCRIPTION OF DRAWINGS

The invention is further illustrated in the following embodiments described with reference to the accompanying drawings. The drawings are for the purpose of describing a particular embodiment only and are not intended to be limiting with respect to the above description.

DETAILED DESCRIPTION

Figure 1:
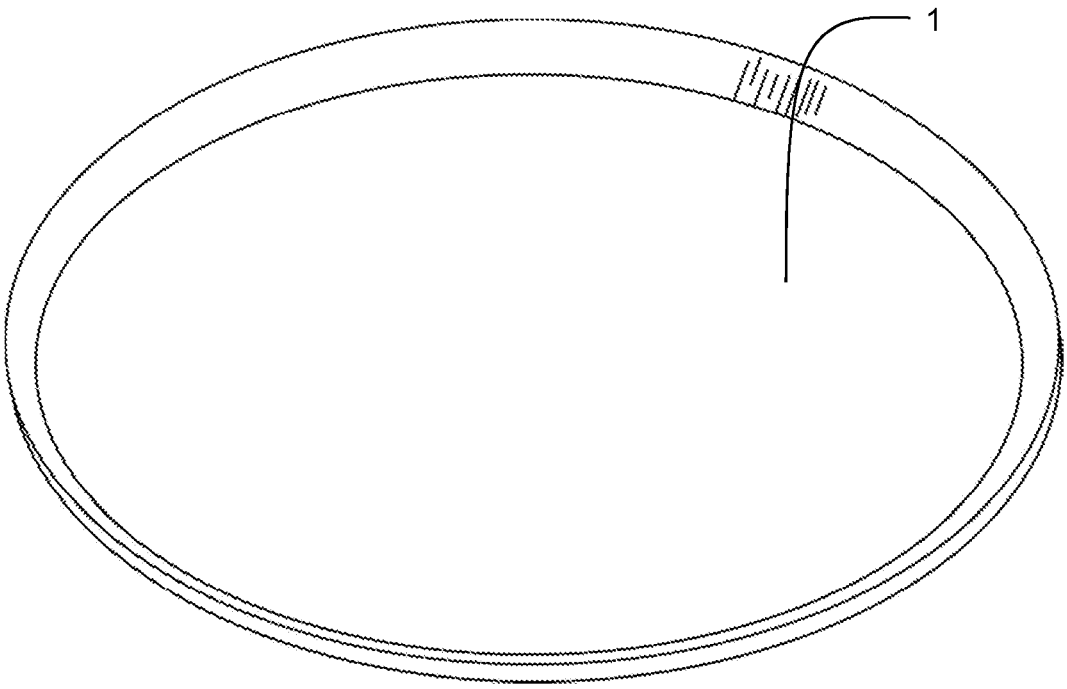
FIG. 1: Provides an isometric view of the upper side of an embodiment of the serving tray of the present invention.
Figure 2:
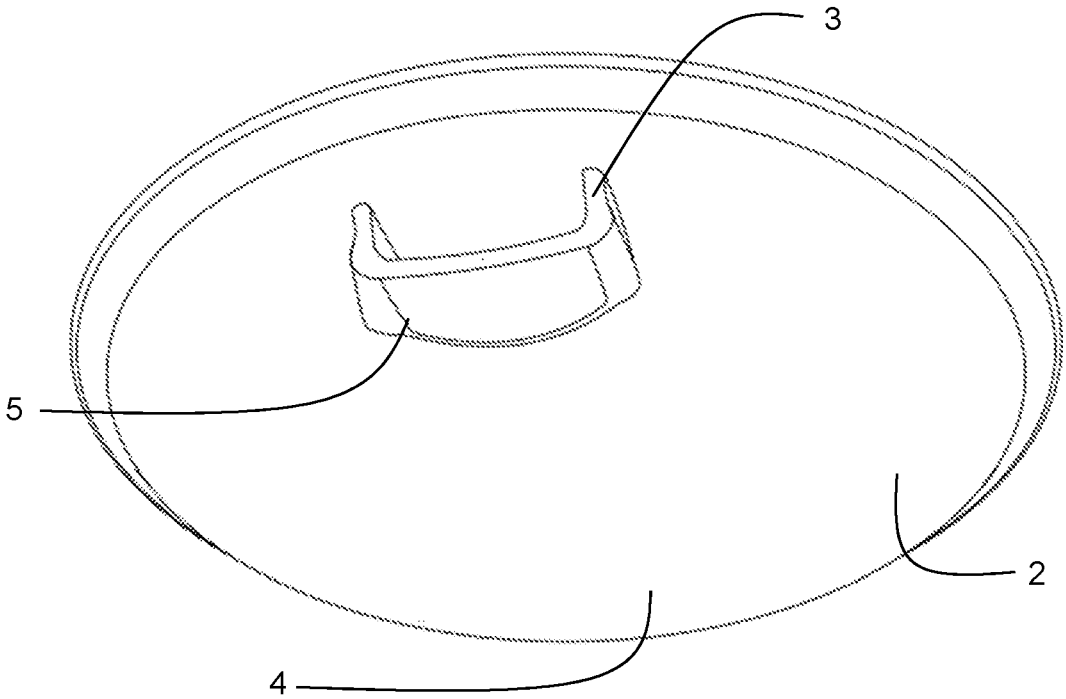
FIG. 2: Provides an isometric view of the underside of an embodiment of the present invention including a single grip.

According to an embodiment of the present invention, as illustrated in FIG. 1 and FIG. 2, there is provided a serving tray, including; an upper side (1) adapted for supporting and carrying items to be served; and an underside (2) including a non-centrally located grip (3), the grip (3) adapted to permit the manual support of the serving tray (in use) by a hand having a generally supine palm (not shown).

The term "supine" is used relative to the position of a waiter when in the upright, standing, position. As such, a generally supine palm is achieved when the hand is rotated such that the palm is facing anteriorly. When the term "supine" is used in relation to a waiter carrying the serving tray of the present invention, the waiter's forearm is extended such that it is generally traverse to the body of the waiter and consequently the palm of the hand is upward facing. The tray of the present invention is configured to permit carriage by a single hand.

A circular plane, upon which items (such a drinks, plates and the like) can be placed, provides the upper side of the tray (1) of the embodiment illustrated in FIG. 1. Further, the upper surface of the tray is provided with a raised perimetric lip, which helps prevent items from sliding off the tray. While a planar surface is particularly versatile, the upper side of the tray can be any suitable surface. For example, the upper side of the tray could include moulded wells which are adapted for cups or glasses to be positioned. Additionally, the upper side can be provided with non-slip coverings, such as a hydrophodic, textured or rubberized covering, which prevents slippage of items being carried.

The serving tray illustrated in the present figures has a generally round shape; however, the upper side of the tray can consist of any desirable shape. Indeed the improved stability provided by the grip(s) of the present invention means that a greater variety of shapes can be used without making the tray problematically unstable. As would be understood, the tray can be any suitable shape. Preferably, however, when the tray is not a circle, the shape of the tray has as many lines of symmetry as the number of handles provided on the tray, or a multiple thereof. For example, a tray having three handles would preferably have three, six or nine lines of symmetry (e.g. a triangle, hexagon or nonagon).

As illustrated in FIG. 2, the underside (2) of the tray includes a non-centrally located grip (3) and a portion (4) adapted to be supported by a forearm. In the illustrated embodiment, the portion (4) adapted to be supported by a forearm is centrally-opposed to the grip, and is provided by the planar surface of the underside (2) of the tray. However, the portion (4) adapted to be supported by the forearm could be provided by any suitable means. These include (but are not limited to) a recessed portion curved in a manner that contours with a forearm, a padded or rubberised section that sits atop of a supine forearm, or a protrusion which includes a contoured portion which locates on the forearm.

The grip (3) illustrated in FIGS. 2 to 5, is provide by a protrusion from the underside (2) of the tray. However, as will be discussed below, the grip can be provided by any suitable means. In the illustrated embodiment, the grip (3) includes a portion (5) which is adapted to sit in the palm of a supine hand. As illustrated in FIGS. 5*a* to 5*d*, this portion (5) is provided by a lower facing surface of the grip (3) which includes a generally planar surface (6). The grip further includes downwardly-projecting lateral protrusions (7) which extend down each the side of the planar surface (6). The lateral protrusions (7) help locate the palm of the hand on the planar surface (6) and stabilises the palm on the grip. Further, the downwardly projecting lateral-protrusions (7), extend beyond the lower, planar, surface (6) of the grip, and act to contact the support surface and elevate the tray when placed on a support surface. The contact area between the downwardly projecting lateral-protrusions (7) and the support surface is reduced relative to the contact area in the absence of the protrusions. This is advantageous when the tray has been washed and is positioned on a surface (such as another tray) to dry. The downwardly projecting lateral-protrusions (7) permit improved airflow around the grips and improve drying times and therefore reduce the growth of bacteria and mould.

The generally planar surface (6) of the grip (3) includes a peripheral-facing edge (11) which is laterally extending and generally concave. This concave edge (11) is more ergonomic than a straight edge when the fingers are curled back toward the palm of the hand when the grip (3) is being held. Furthermore, the centrally facing edge (12) of the planar surface (6) of the grip (3) is laterally extending and generally convex. The convex centrally facing edge (11) is shaped to sit against the heel of the palm when the grip (3) is being held. The term "laterally extending", when used in the context of the peripheral-facing and centrally-facing edges of the grip, is to be considered relative to the hand of the user and as such the edges extend across the hand of the user. Consequently, in some embodiments, the peripheral-facing and centrally-facing edges of the grip are substantially perpendicular to a radial line that intersects the centre of the grip.

The grip (3) illustrated in FIGS. 2 to 5, further includes a recess (8) for engagement by the fingers of the hand (not shown). The recess (8) of the present invention includes a drainage hole (9) which allows for water, which may collect in the recess during washing, to drain out. Consequently, the recess (8) illustrated in the Figures functionally provides an aperture which passes through the protruding grip (3), the recess (8) being adapted for engagement with the fingers of a hand.

The grip is oriented on the tray with the recess (8), for engagement with the fingers of a hand, located toward the periphery of the tray. Furthermore, the grip (3) of the illustrated embodiment includes a centrally facing side (10) which is generally contoured to fit the heel of the palm of a hand. Preferably, the contour of the centrally facing side (10) of the grip (3) is provided by a portion which tapers toward the centre and the bottom surface of the tray (see FIG. 5*e*) which is configured to conform with the natural contour of the heel of the palm when the hand is extended from a neutral position. This configuration assists in improving the ergonomics of the tray.

As illustrated in FIG. 5*d*, the lateral side of the grip (3) includes a contoured portion (11). This portion provides an optional area for locating the thumb of the waiter's hand when the tray is being carried, while the four fingers are located within the recess (8) of the grip (3) and it may provide additional comfort to the user and may further stabilise the tray. However, as will be understood, the thumb does not need to be positioned on the laterally positioned contoured portion (11) of the grip during use.

The combination of the features described above, provides a grip (3) which is adapted to be gripped with the palm of a hand in a generally supine position such that it abuts the lower surface of the grip (5), primarily the generally planar surface of the grip (6), and one or more fingers of the hand curled inward toward the palm to engage the recess (8).

Figure 4:
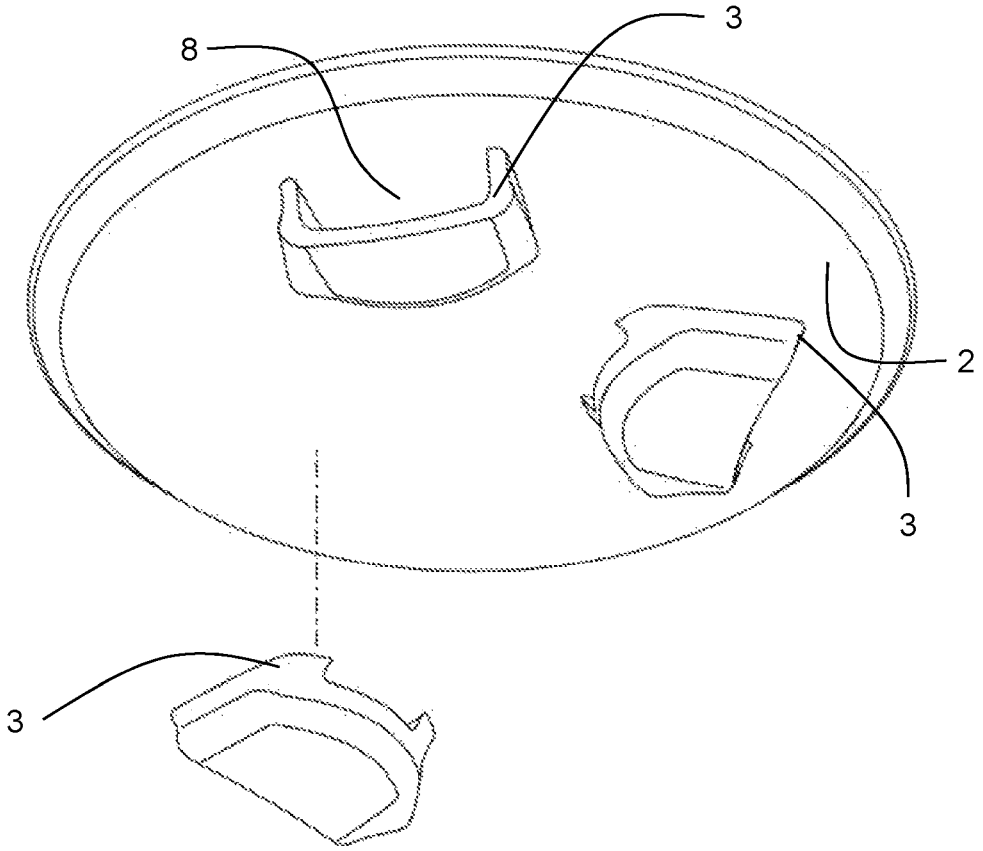
FIG. 4: Provides an isometric view of the underside of an embodiment of the present invention and illustrates the attachment of a grip to a pre-formed serving tray.
Figure 5:
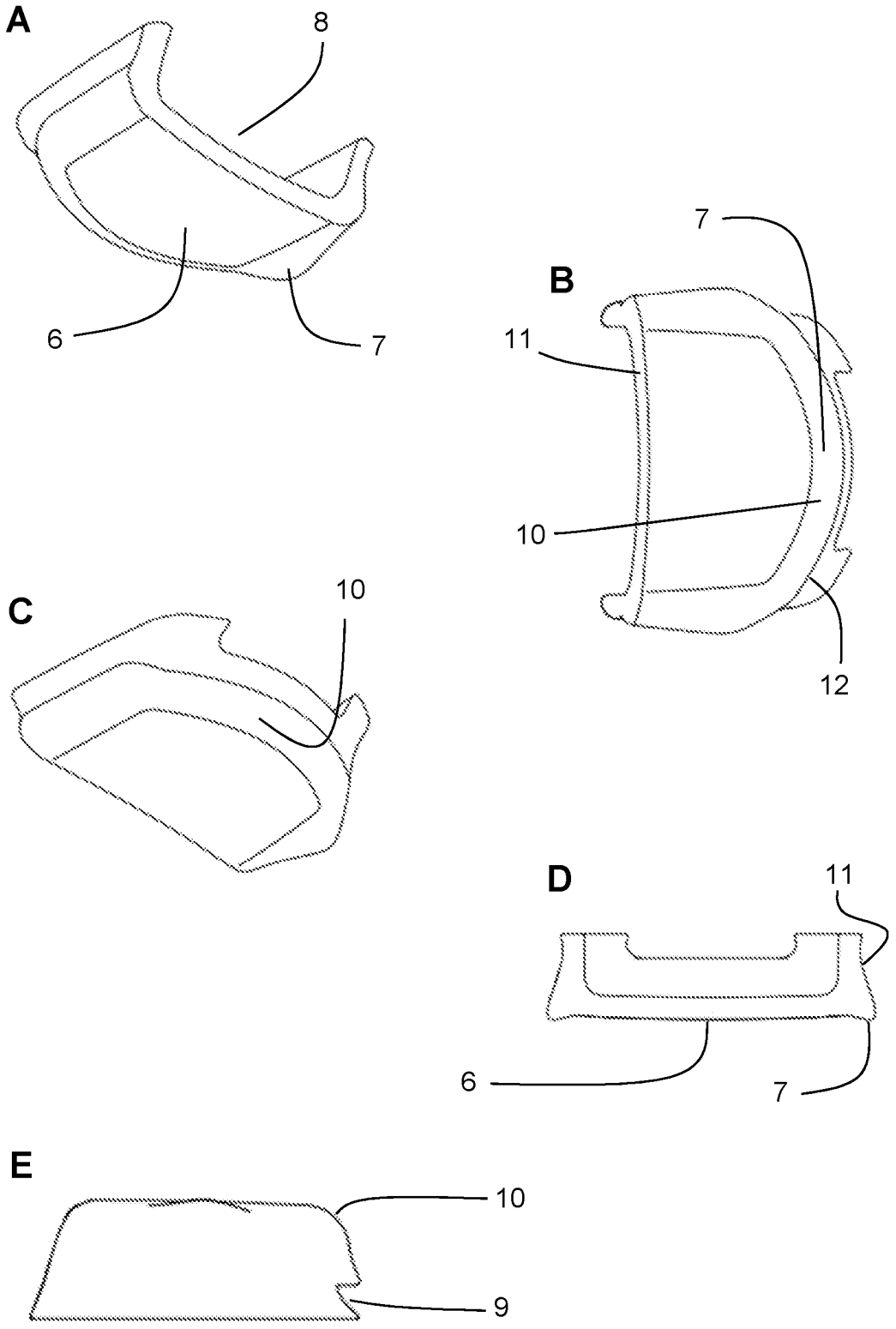
FIG. 5*a*: Provides an isometric view of the underside of a grip for use in an embodiment of the present invention, and illustrates a recess in the peripheral facing side of the grip for engagement by the fingers of a hand.
FIG. 5*b*: Provides a view of the underside of a grip for use in an embodiment of the present invention.
FIG. 5*c*: Provides an isometric view of the underside of a grip for use in an embodiment of the present invention, and illustrates an aperture on the centrally-facing side of the grip to allow water drainage.
FIG. 5*d*: Provides a view of the peripheral facing side of a grip, for use in an embodiment of the present invention.
FIG. 5*e*: Provides a side view of a grip, for use in an embodiment of the present invention.

The grip (3) described above can be connected, or attached to, the tray in any suitable manner. In some embodiments (as illustrated in FIG. 4) the grips (3) are formed separately to the tray and are attached. In this manner, the serving tray of the present invention can be produced by attaching the grips (3) to a pre-formed serving tray. Techniques are known in the art for such attachment such as plastic welding. For example when thermoplastics are used, the surface of the plastics can be softened with heat and then the grip (3) can be positioned on the underside of the tray (2) before the plastic hardens, thereby attaching the grip (3) to the tray. Alternative plastic welding approaches can also be used, which are not dependent on heat, such as solvent welding. Alternatively, the serving tray can be formed as a unitary object with the grips (3) integrally formed with the tray. Again, techniques are known in the art for such methods of formation, such as injection moulding. This manner of production is preferred when the grips (3) are provided by recesses in the underside (2) of the tray, however, this technique can also be used when the grips (3) include, or are provided by, a protrusion.

It is desirable to have the grip(s) (3) attached or integrated in the serving tray of the present invention in a manner such that they cannot be separated or be removed from the upper side of the tray. As trays in accordance with the present invention are intended for use in commercial environments, it is important that they are robust and that components cannot be lost, removed, or easily damaged. Consequently, in a preferred form of the invention, the grips are integral in the underside of the tray, and are immovable relative to the underside of the tray.

The tray of the present invention can be formed of any suitable material. In preferred embodiments, the tray is made of dishwasher-safe material, being material that can tolerate high heat (>80° C.) and caustic or alkaline conditions. Suitable plastics and metals are known in the art, which may be used to form the serving tray of the present invention.

The above-described embodiment of a serving tray illustrated in FIGS. 2 to 5 relate to an embodiment of the invention which includes a protruding grip. However, embodiments of the invention wherein the grip is recessed in the underside of the tray are envisaged to be within the scope of the invention. For example, in one such embodiment, a recess can be provided in the underside of the tray, which is adapted to be engaged by the inwardly-curled fingers of a waiter, while the waiter's supine palm abuts a substantially planar underside. Further embodiments, may include a recess portion in the underside of the tray, with a protruding portion, wherein the protruding portion is adapted to be gripped with the palm of a hand in a generally supine position and one or more fingers of the hand curled inward toward the palm, and located within the recess.

Figure 3:
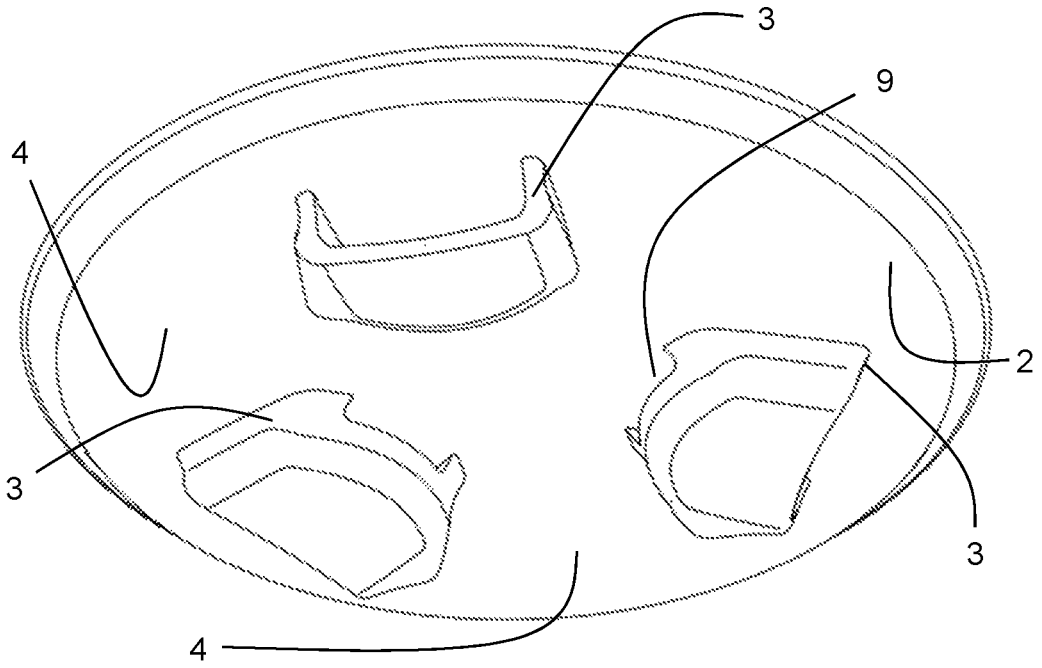
FIG. 3: Provides an isometric view of the underside of an embodiment of the present invention including three grips.

FIG. 3 illustrates a preferred embodiment of the serving tray of the present invention. The underside (2) of the serving tray is provided with three grips (3), each grip evenly space around the centre of the tray and interspaced with three portions (4) adapted to be supported by a forearm. While any suitable number of grips (3) can be included on the underside (2) of the tray, an odd number of grips is advantageous. When the odd number of grips (3) are evenly spaced around the centre of the tray, and interspaced with portions (4) adapted to be supported by a forearm, the portions (4) adapted to be supported by a forearm will be centrally-opposed to the grip (3). As such, it is advantageous for each grip (3) to not be centrally-opposed to another grip (3) or for no portion of any grip to be centrally-opposing a portion of another grip. However, even when one grip (3) is centrally-opposed to another grip (3) (not shown), then the lower surface of the grips may provide, or include, the portion (4) adapted to be supported by a forearm.

As can be seen, the underside of the tray does not have any obstruction between the grip and the portion adapted for the forearm. This is important to allow the tray to be stably positioned on the arm when carried.

Furthermore, the illustrated embodiment of the serving tray has the particular benefit of being able to sit level when placed upon a surface. In the illustrated embodiment of FIG. 3, the grips (3) form a tripod arrangement, wherein the grips (3), and their associated downwardly projection lateral protrusions (7), function as legs when the tray is placed upon a surface. Consequently, in the event that a waiter wished to set the tray down, while items are on the upper side (1) of the tray, then the upper side (1) of the tray will sit parallel to the surface upon which the tray is placed and will balance and support the items. Furthermore, multiple trays can be stored by being stacked upon each other. In the illustrated embodiment, the grips (3) are positioned equidistant from each other such that they are positioned in the form of an equilateral triangle. As such, the radial angle between notional lines traversing the midpoint of each adjacent grip, is identical.

While the embodiment illustrated in FIGS. 3 and 4 is provided with three grips (3), it is envisaged that the invention may have a lesser or greater number of grips (3). Indeed three or more grips (3), positioned appropriately on the tray, will be sufficient to provide stability to the tray when placed upon a surface. Preferably, the tray will have an odd number of grips, such that positioning of the grips at equidistant spacing, near the periphery of the tray, will result in the grips interspaced with portions (centrally opposed to another grip) adapted to be supported by the forearm of a waiter. However, as explained above, embodiments of the tray can be provided with alternative means, such as legs, to stabilise the tray when placed upon a surface.

For the reasons outlined above, it is advantageous for the serving tray of the present invention to be configured so that it will sit level when placed upon a level surface. This is achieved by configuring the underside of the tray such that when the tray is placed on a surface, the upper side of the tray will sit parallel to the surface upon which the tray is placed. While a preferred embodiment of the invention, which provides such a configuration, is described above, other means for providing this configuration are envisaged. For example, in some embodiments, the underside of the tray can be provided with legs (or other protrusions) which act to stabilise and support the tray. These legs can be in addition to, or in place of, multiple grips. Consequently, in some embodiments, the serving tray of the present invention may be provided with one grip, and two or more legs for stabilising the tray when placed upon a support surface. Alternatively, in embodiments where the grips do not protrude from the underside of the tray (e.g. where they are recessed or otherwise provided on the underside of the tray), the underside may provide a substantially planar surface which is adapted to sit on a support surface.

It will be apparent to the person skilled in the art that while the invention has been described in some detail for the purposes of clarity and understanding, various modifications and alterations to the embodiments described herein may be made without departing from the scope of the inventive concept disclosed in this specification.

The description provided herein is in relation to several embodiments which may share common characteristics and features. It is to be understood that one or more features of one embodiment may be combinable with one or more features of the other embodiments. In addition, a single feature or combination of features of the embodiments may constitute additional embodiments.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

The claims defining the invention are as follows:

1. A serving tray, including:

an upper side adapted for supporting and carrying items to be served;

an underside including three non-centrally located grips, the grips adapted to permit the manual support of the serving tray by a hand having a generally supine palm, wherein the underside includes three portions adapted to be supported by a forearm; and wherein each of the three non-centrally located grips include at least one downwardly projecting protrusion that extends beyond a lower surface of each grip, and abuts a support surface when the tray is positioned thereon.

2. The serving tray of claim 1, wherein the portions adapted to be supported by a forearm are centrally-opposed to the non-centrally located grips.

3. The serving tray of claim 1, wherein the underside of the tray is configured such that when the tray is placed on a surface, the upper side of the tray will sit parallel to the surface upon which the tray is placed.

4. The serving tray of claim 1, wherein each grip includes a portion adapted for engagement by the fingers of the hand.

5. The serving tray of claim 1, wherein each grip is adapted to be gripped with the palm of a hand in a generally supine position and one or more fingers of the hand curled inward toward the palm.

6. The serving tray of claim 1, wherein each grip includes a recessed portion adapted for engagement by the fingers of the hand.

7. The serving tray of claim 6, wherein the recessed portion includes a drainage hole to permit drainage of water from the recessed portion.

8. The serving tray of claim 1, wherein each grip includes, or is provided by, a protrusion on the underside of the tray.

9. The serving tray of claim 8, wherein each protrusion includes a surface adapted to be supported by the generally supine palm.

10. The serving tray of claim 8, wherein each protrusion includes a recess, or aperture, for engagement by the fingers of a hand.

11. The serving tray of claim 10, wherein each protrusion is adapted to be gripped with the palm of a hand in a generally supine position and one or more fingers of the hand curled inward toward the palm and engaged in the recess or aperture.

12. The serving tray of claim 11, wherein the recess or aperture for engagement by the fingers of a hand is located toward the periphery of the tray and each protrusion further includes a contoured centrally-facing side.

13. The serving tray of claim 12, wherein the contoured centrally-facing side is provided by a portion of the grip which tapers towards the centre, and the bottom surface, of the tray.

14. The serving tray of claim 1, wherein the grips are not centrally-opposed to other grips included on the underside of the tray.

15. The serving tray of claim 1, wherein the at least one downwardly projecting protrusions that extends beyond a lower surface of each grip is laterally positioned on each grip.

16. The serving tray of claim 1, wherein each of the three non-centrally located grips include at least two downwardly projecting protrusions that extend beyond a lower surface of each grip and abut a support surface when the tray is positioned thereon.

17. The serving tray of claim 15, wherein each of the three non-centrally located grips include at least two downwardly projecting protrusions that extend beyond a lower surface of each grip and abut a support surface when the tray is positioned thereon.

* * * * *